US007308888B2

(12) United States Patent
Williams et al.

(10) Patent No.: US 7,308,888 B2
(45) Date of Patent: Dec. 18, 2007

(54) CAM ARRANGEMENT AND FUEL PUMP ARRANGEMENT INCORPORATING A CAM ARRANGEMENT

(75) Inventors: Anthony John Williams, Isleworth (GB); Anthony Thomas Harcombe, Richmond (GB)

(73) Assignee: Delphi Technologies, Inc., Troy, MI (US)

( * ) Notice: Subject to any disclaimer, the term of this patent is extended or adjusted under 35 U.S.C. 154(b) by 261 days.

(21) Appl. No.: 10/539,873

(22) PCT Filed: Dec. 18, 2003

(86) PCT No.: PCT/GB03/05554

§ 371 (c)(1),
(2), (4) Date: Jun. 17, 2005

(87) PCT Pub. No.: WO2004/055359

PCT Pub. Date: Jul. 1, 2004

(65) Prior Publication Data

US 2006/0073038 A1 Apr. 6, 2006

(30) Foreign Application Priority Data

Dec. 18, 2002 (GB) ..... 0229487.4

(51) Int. Cl.
*F02M 37/04* (2006.01)
*F02M 37/06* (2006.01)

(52) U.S. Cl. ..... 123/508; 239/89

(58) Field of Classification Search ..... 123/495, 123/468, 508, 507, 502, 446; 239/88–95
See application file for complete search history.

(56) References Cited

U.S. PATENT DOCUMENTS

| | | | | |
|---|---|---|---|---|
| 3,827,419 | A | 8/1974 | Isomura | |
| 4,378,774 | A * | 4/1983 | Kato | 123/446 |
| 4,463,725 | A * | 8/1984 | Laufer et al. | 123/446 |
| 4,471,909 | A * | 9/1984 | Perr | 239/89 |
| 4,531,672 | A * | 7/1985 | Smith | 239/89 |
| 4,567,872 | A * | 2/1986 | Roosa | 123/470 |
| 4,951,631 | A * | 8/1990 | Eckert | 123/446 |

(Continued)

FOREIGN PATENT DOCUMENTS

| | | |
|---|---|---|
| EP | 0778412 | 6/1977 |

(Continued)

*Primary Examiner*—Mahmoud Gimie
(74) *Attorney, Agent, or Firm*—David P. Wood

(57) ABSTRACT

A cam arrangement for use with a high pressure fuel pump arrangement for delivering fuel to an associated engine, the cam arrangement including at least two cams (28) that are mounted, in use, upon an engine camshaft and each of which is arranged to drive a respective pumping plunger (16) of the fuel pump arrangement, wherein each plunger is driven to perform a pumping stroke, against return biasing means (32), during which fuel within a pump chamber (22) associated with each plunger is pressurised, and whereby said return biasing means (32) effects a plunger return stroke, and wherein each cam (28) is oriented relative to the or each other cam and has a surface (50) shaped such that the associated plunger return stroke is interrupted to define at least one step of plunger movement that is substantially synchronous with the pumping stroke of another of the plungers (16) of the pump, thereby to reduce negative torque loading of the camshaft.

13 Claims, 6 Drawing Sheets

U.S. PATENT DOCUMENTS

| | | | | |
|---|---|---|---|---|
| 4,962,743 | A | 10/1990 | Perr et al. | |
| 5,032,066 | A | 7/1991 | Baty | |
| 5,611,317 | A * | 3/1997 | Peters et al. | 123/501 |
| 6,230,689 | B1 | 5/2001 | Tengroth et al. | |
| 6,516,783 | B2 * | 2/2003 | Dutart et al. | 123/446 |
| 7,063,072 | B2 * | 6/2006 | Persson et al. | 123/446 |

FOREIGN PATENT DOCUMENTS

| | | |
|---|---|---|
| EP | 1072785 | 1/2001 |
| EP | 1219827 | 7/2002 |
| EP | 1359316 | 11/2003 |
| GB | 1480002 | 7/1977 |
| GB | 2026600 | 2/1980 |
| GB | 2057065 | 3/1981 |
| GB | 2112871 | 7/1983 |

* cited by examiner

CAM ARRANGEMENT AND FUEL PUMP ARRANGEMENT INCORPORATING A CAM ARRANGEMENT

TECHNICAL FIELD

The invention relates to a cam arrangement for use with a fuel pump arrangement for delivering fuel at high pressure to the combustion space in a compression ignition internal combustion engine. The invention also relates to a single cam for use in such a cam arrangement, and to a fuel pump arrangement incorporating such a cam arrangement.

BACKGROUND ART

Fuel injection systems for compression ignition engines typically include a plurality of fuel injectors, each of which is associated with one cylinder of the engine. It is known to provide each injector with an associated pumping element, in the form of a pumping plunger, which is slidable within a bore provided in a barrel under the influence of a cam arrangement to cause pressurisation of fuel within an associated pump volume or chamber. In a so-called unit injector, the pumping plunger is arranged within a common unit with the associated injector, so that fuel that is pressurised within the pump chamber of the unit is delivered only to the associated injector, and to no other injectors. Multiple-cylinder engines therefore include a multiple number of such units, with one unit being provided for each engine cylinder. As an alternative, unit pumps may be used for which the injector is not housed within the same unit as it's dedicated pumping plunger.

Each unit injector has an associated cam arrangement, each of which includes a lobed cam mounted upon a camshaft upon which the cams associated with units of the same bank of engine cylinders are also mounted. The camshaft may be driven through a gear train by an engine crank shaft, or by means of a belt or chain drive. In a four-stroke engine, the camshaft is driven at half of the speed of the crank shaft. Each unit injector has a drive member that is usually coupled to one end of the plunger through an intermediate member. A cam follower or roller rides over the surface of the associated cam as it is driven, thereby imparting drive to the drive member, and hence to the plunger, to cause the plunger to reciprocate within its bore.

For each complete 360 degree rotation of the camshaft, each pumping plunger performs a pumping cycle including a pumping phase and a retraction phase. During the pumping phase the plunger performs a pumping stroke in which the plunger is driven inwardly within the bore by means of the cam drive, against the force of a return spring. During the pumping stroke the volume of the pump chamber is reduced, causing fuel within the pump chamber to be pressurised to a relatively high level. During the retraction phase of the pumping cycle the plunger performs a return stroke, during which the pumping plunger is urged outwardly from the bore to increase the volume of the pump chamber. The return spring acts in combination with residual fuel pressure within the pump chamber to effect the plunger return stroke. The unit injectors are assembled relative to the camshaft with the lobes of the cams angularly offset from one another, and so that the pumping phase of each plunger is coincident with the end of the compression stroke for the associated cylinder. In a four cylinder engine, for example, having four unit injectors, when one pumping plunger is at the start of its pumping stroke, a second may be at top dwell and a third and a fourth may be part way through their return strokes.

The surface of each cam is profiled to include a rising flank and a falling or trailing flank. When performing the pumping stroke, the cam follower rides up the rising flank as the cam rotates, and during the return stroke the cam follower rides down the falling flank. The cam surface may be profiled such that at the end of plunger pumping stroke but just before the return stroke commences, the cam follower dwells for a period of time at the peak of the rising flank (referred to as "top dwell"). Similarly, at the end of the return stroke, the cam follower dwells for a period of time (referred to as "bottom dwell") before commencing the pumping stroke of the next pumping cycle. Essentially, therefore, the pumping cycle includes four phases; a pumping phase, a period of top dwell, a retraction phase and a period of bottom dwell.

It has been recognised that in multiple cylinder fuel injection systems of the aforementioned type, the camshaft experiences a variable torque loading throughout the pumping cycle. Variable torque loading arises partly as a result of the cumulative effect of the return spring loads acting on the cams. Such variation between positive and negative torque loading, or "torque reversal", can give rise to undesirable impacts between the cam and its gear train or other drive components, due to backlash or play between the components.

There is an additional torque loading on the camshaft due to the force of high pressure fuel within the pump chambers. For each unit injector, the torque loading due to fuel pressure is high during the pumping stroke but is much lower for the remainder of the pumping cycle. The resultant, pulsating positive torque loading acts in phase with the positive torque loading that originates from the return springs. As a result, it has been found that the camshaft experiences several large positive torque loading pulses (one for the combustion event within each cylinder) separated by periods of negative torque loading.

Our co-pending European patent application EP 1359 316 A describes a hybrid fuel injection system in which one or more cam driven pumping elements is combined with a common rail accumulator volume to enable injection at two different fuel pressure levels. Due to the provision of the common rail accumulator volume, significant fuel pressures are present within the pump chambers throughout full rotation of the cam, and the camshaft therefore experiences periods of particularly large negative torque loading between the positive torque loading pulses. The problems associated with torque loading reversal, as described previously, are therefore exaggerated in hybrid systems of this type.

It is an object of the present invention to provide a cam arrangement that avoids or alleviates the aforementioned problem. It is a further object of the present invention to provide a fuel pump arrangement incorporating such a cam arrangement.

SUMMARY OF THE INVENTION

According to a first aspect of the present invention, there is provided a cam arrangement for use with a high pressure fuel pump arrangement for delivering fuel to an associated engine, wherein the cam arrangement includes at least two cams that are mounted, in use, upon an engine camshaft and each of which is arranged to drive a respective pumping plunger of the pump arrangement, wherein each plunger is driven to perform a pumping stroke, against return biasing means, during which fuel within a pump chamber associated with each plunger is pressurised, and whereby said return biasing means effects a plunger return stroke, and wherein each cam is oriented relative to the or each other cam and has a surface shaped such that the associated plunger return stroke is interrupted to define at least one discrete step of plunger movement that is substantially synchronous with the pumping stroke of another of the plungers, thereby to reduce negative torque loading of the camshaft.

Negative torque loading of the camshaft is a common problem encountered with conventional cam designs, and may result in the occurrence of backlash in the camshaft gear train, belt or chain drive as a result of torque load reversal. The shaping of the cam surfaces to provide discontinuous or interrupted movement throughout the return stroke, and the coinciding of each step of movement through the return stroke of one plunger with the pumping stroke of another of the plungers, provides the advantage that negative torque loading of the camshaft between positive torque loading peaks can be substantially reduced or avoided altogether. It is a further benefit of the present invention that the peak torque loading of the camshaft is reduced.

For a four cylinder engine, for example, the cam arrangement preferably includes four cams having cam surfaces of substantially identical form. For a six cylinder engine, the cam arrangement preferably includes six cams having cam surfaces of substantially identical form.

In one embodiment, each cam surface is shaped to include a rising flank, and wherein the remainder of the cam surface includes an irregularity which defines an interval of interruption in the return stroke of the associated plunger.

In a preferred embodiment, the remainder of each cam surface includes one or more irregularities, each of which defines an interval of interruption in the plunger return stroke, and wherein the cams are mounted upon the engine camshaft, in use, at angularly offset positions to ensure the or each step of movement through each plunger return stroke substantially coincides with the pumping stroke of one of the other plungers, in use.

In one embodiment, each cam surface may be shaped to provide a number of steps of movement through the plunger return stroke that is equal to the number of other plungers in the pump.

Alternatively, it may be preferable for the cam surface to be shaped such that there is a relatively long period of top dwell prior to commencement of the return stroke, in which case the cam surface may be shaped such that the number of steps of movement through each plunger return stroke is less than the total number of other plungers in the pump. Typically, for example, it may be desirable for top dwell to continue until 90 degrees of cam rotation relative to a cam reference position at or close to commencement or start of the pumping stroke for that plunger. In this case, therefore, it may be desirable to provide a relatively long period of top dwell, for example, if a post injection of fuel is to be provided near or just after the end of the pumping stroke, following a main injection of fuel.

Similarly, if a relatively long period of bottom dwell is required, for example between 300 and 360 degrees of cam rotation relative to the cam reference position, the number of steps of movement of each plunger return stroke is less than the number of other plungers in the pump.

It will be appreciated that the cams are mounted upon the camshaft at angularly offset positions, to ensure the or each step of each plunger return stroke substantially coincides with the pumping stroke of one of the other plungers, in use.

A second aspect of the invention relates to just a single cam, for use in the cam arrangement or fuel pump arrangement described herein, wherein the cam has a surface shaped appropriately for use with one or more other cams, driven by the same camshaft, to provide the aforementioned beneficial camshaft torque loading characteristics.

The cam arrangement of the present invention is suitable for use with a fuel pump arrangement including a plurality of pumping plungers, each of which forms part of a unit injector including a unit housing for the plunger and an associated injector, and whereby each pump chamber is arranged to deliver fuel to the associated injector, and to no other injector. The cam arrangement of the present invention is suitable for use in unit injectors of the type having an injection control valve means to control fuel injection timing and/or injection rates.

The cam arrangement of the present invention is also suitable for use with a fuel pump forming part of a hybrid unit injector-common rail fuel injection system, including an accumulator volume or common rail for delivering fuel to the pump chambers of the unit injectors under the control of a control valve. In such systems, fewer plungers than injectors may be provided due to the provision of the common rail.

According to a third aspect of the invention, there is provided a fuel pump arrangement for delivering high pressure fuel to an associated engine, the fuel pump arrangement including at least first and second pumping plungers, each having an associated pump chamber and return biasing means for effecting a return stroke of the plunger, and an associated cam for driving the plunger to perform a pumping stroke against the return biasing means, during which pumping stroke fuel within the pump chamber is pressurised, and wherein each cam is oriented relative to the or each other cam and has a surface shaped such that the associated plunger return stroke is interrupted to define at least one step of movement through the return stroke that is substantially synchronous or coincident with the pumping stroke of another of the plungers of the pump, thereby to reduce negative torque loading of the camshaft.

Preferably, each plunger is slidable within a plunger bore, and whereby the associated return biasing means serves to urge the plunger outwardly from the plunger bore so as to perform the return stroke.

The return biasing means preferably takes the form of return spring means, typically in the form of a return spring.

In one embodiment, each of the plungers forms part of a unit injector, including a unit housing for the plunger and an associated injector, and whereby the pump chamber is arranged to deliver fuel to the associated injector, and to no other injector.

The fuel pump arrangement of the third aspect of the invention may also include one or more unit injectors having an injection control valve means to control fuel injection timing and/or injection rates.

In another embodiment of the third aspect of the invention, the fuel pump arrangement may form part of a hybrid unit/pump injector-common rail fuel injection system, including an accumulator volume or common rail from which fuel is delivered to the pump chambers of the unit injectors under the control of a control valve.

In a preferred embodiment, the fuel pump arrangement includes three or more plungers each having an associated cam, wherein each cam is oriented relative to the other cams and has a surface shaped such that the return stroke for each plunger has one or more intervals of interruption, and such that each of said steps of movement is substantially synchronised with the pumping stroke for one of the other plungers.

According to a further aspect of the present invention, there is provided a cam arrangement for use with a high pressure fuel pump arrangement for delivering fuel to an associated engine, wherein the cam arrangement includes first and second cams that are mounted, in use, upon an engine camshaft and each of which is arranged to drive a respective one of first and second pumping plungers of the pump arrangement, wherein each of the first and second pumping plungers is driven to perform a pumping stroke, against return biasing means, during which fuel within a pump chamber associated with each plunger is pressurised, and whereby said return biasing means effects a plunger return stroke, and wherein the first and second cams are oriented relative to each other and each has a surface shaped such that the associated plunger return stroke is substantially synchronous or coincident with the pumping stroke of the other plunger, thereby to reduce negative torque loading of the camshaft.

In one embodiment of this aspect of the invention, the cams are shaped such that each plunger return stroke is interrupted just once to define an interruption separating two discrete steps of movement through the return stroke, and whereby one of said steps of movement is substantially synchronous or coincident with the pumping stroke of the other plunger.

This aspect of the invention may include at least one further cam associated with a further plunger, wherein each plunger return stroke is substantially synchronous or coincident with the pumping stroke of another of the plungers.

For the purpose of this specification, the phrase "substantially synchronous" is intended to cover cam surface shaping which provides for close matching between the steps of movement of the return stroke with the pumping stroke of another plunger or plungers, but does not limit the invention to exact synchronisation between the two. The technical benefit provided by the invention, that negative torque loading of the cam is substantially eliminated, and hence torque load reversal is substantially eliminated, may still be achieved if the steps of movement through the plunger return stroke depart from the pumping stroke by, say, a few degrees of cam rotation.

It will be appreciated that the optional and/or preferred aspects of the first aspect of the present invention may be incorporated alone or in appropriate combination within the other aspects of the invention also.

BRIEF DESCRIPTION OF THE DRAWINGS

Preferred embodiments of the invention will now be described, by way of example only, with reference to the accompanying drawings in which.

DETAILED DESCRIPTION OF PREFERRED EMBODIMENTS

Figure 1:
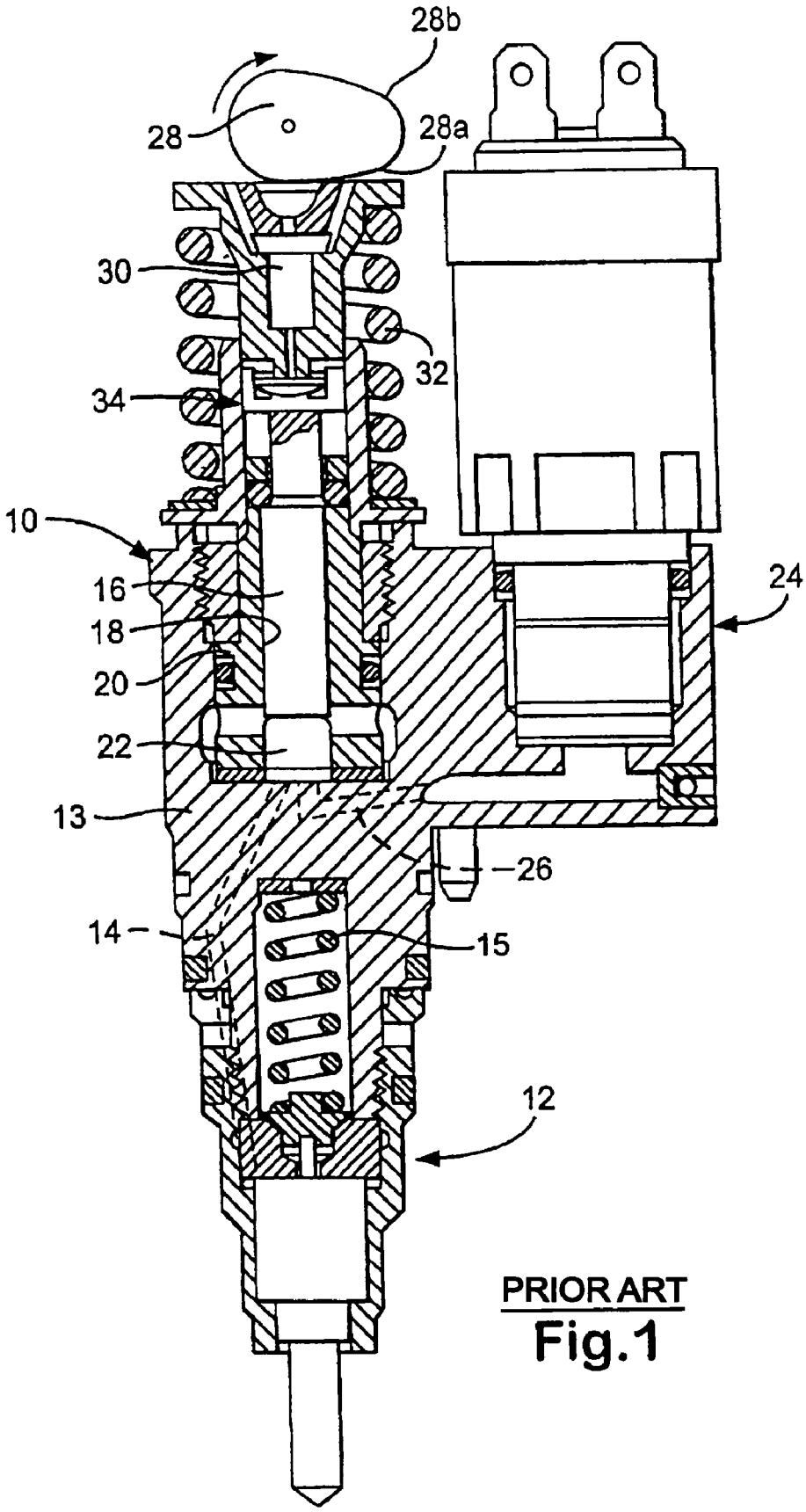
PRIOR ART Fig.1
FIG. 1 is a sectional view of a unit injector having a cam with a conventional surface profile.

Referring to FIG. 1, a unit injector of known design for use in a fuel injection system includes a pumping element, referred to generally as 10, and an injector element, referred to generally as 12. The pumping element 10 and the injector element 12 are mounted within a common unit injector housing 13 with a high pressure supply line 14 for fuel interconnecting the two. The injector element 12 is of well known construction, and typically includes a valve needle (not shown) which is operable to open and close one or more injector outlets so as to control fuel delivery into the associated engine cylinder. The valve needle is urged into its closed state by means of a valve needle return spring 15 arranged at a back end of the needle remote from the outlets. When fuel pressure delivered to the injector element 12 is increased sufficiently, a hydraulic force acts on the valve needle to oppose the spring force, lifting the valve needle to its open state and thus commencing injection. Typically, the unit injector is one of several, forming part of a so-called "pump arrangement", with each unit injector being arranged to deliver high pressure fuel to a different one of the engine cylinders.

The pumping element 10 includes a pumping plunger 16, which is slidable within an internal plunger bore 18 of a barrel or cylinder 20 mounted in the unit housing 13. The plunger 16 reciprocates within the bore 18 to cause pressurisation of fuel within a pump chamber 22 in communication with the high pressure fuel supply line 14. A spill valve arrangement 24 is mounted upon one side of the injector housing 13, and is operable to open and close communication between the pump chamber 22 and a low pressure fuel drain (not shown) through a drain passage 26. Typically, the spill valve 24 is controlled by means of an electromagnetic actuator.

The pumping plunger 16 is reciprocable within the bore 18 under the control of a cam arrangement including a rotatable cam 28, which is mounted upon an engine driven camshaft (not shown) and arranged to drive a tappet 30 against the action of return biasing means. Typically, the return biasing means takes the form of a plunger return spring 32, but it is also possible that a return force for the plunger is effected by means of an hydraulic force. The tappet 30 is cooperable with the cam 28, such that upon rotation thereof it is driven to impart inward movement to the pumping plunger 16 through a load transmission arrangement 34 such that the plunger performs a pumping cycle. Typically, an intermediate roller or cam follower member (not shown) is also provided, which cooperates with the surface of the cam 28 to impart drive to the tappet 30. The construction and operation of the unit injector shown in FIG. 1 is described in our published European patent application EP 1072 785 A.

The surface of the cam 28 has a rising flank **28*a* and a falling flank 28*b*. In use, as the cam 28 is rotated, the tappet 30 rides up the rising flank 28*a*, causing the plunger 16 to be driven inwardly within the bore 18, to perform a pumping stroke. The pumping stroke is effected during a so-called "pumping phase" of the pumping cycle. During the pumping stroke the volume of the pump chamber 22 is reduced. If the spill valve 24 is open during the pumping stroke, fuel is dispelled from the pump chamber 22 due to the open communication with the low pressure drain, but if the spill valve 24 is closed the pumping stroke results in pressurisation of fuel within the pump chamber 22** to a relatively high level. High pressure fuel is delivered to the fuel supply line 14, and when the pressure level reaches an amount which is sufficient to overcome the force of the valve needle spring, the valve needle is caused to lift from its seating to commence injection.

At the end of the pumping stroke as the tappet 30 rides over the top of the rising flank, the tappet 30 may dwell for a short period of time, at "top dwell", before riding down the falling flank 28*b*. During the subsequent retraction phase, the plunger 16 is urged outwardly from the bore 18 to perform a return stroke under the influence of the return spring 32 (and residual fuel pressure within the pump chamber 22 following injection). At the end of the return stroke the pumping plunger 16 may dwell for a short period at "bottom dwell" before commencing the pumping stroke of the next pumping cycle.

In a multi-cylinder engine, a plurality of unit injectors such as that shown in FIG. 1 are provided, with one unit being provided to deliver fuel to each cylinder of the engine by means of its dedicated injector element 12. In a six cylinder engine, for example, six units are provided, each having a respective pumping plunger which is driven, through an associated tappet, by means of an associated cam. The six cams are mounted upon a common camshaft (not shown), which is driven by an engine crank shaft at half of the speed of rotation of the crankshaft. The camshaft is usually driven by a belt or chain drive, or through a gear arrangement.

Figure 2:
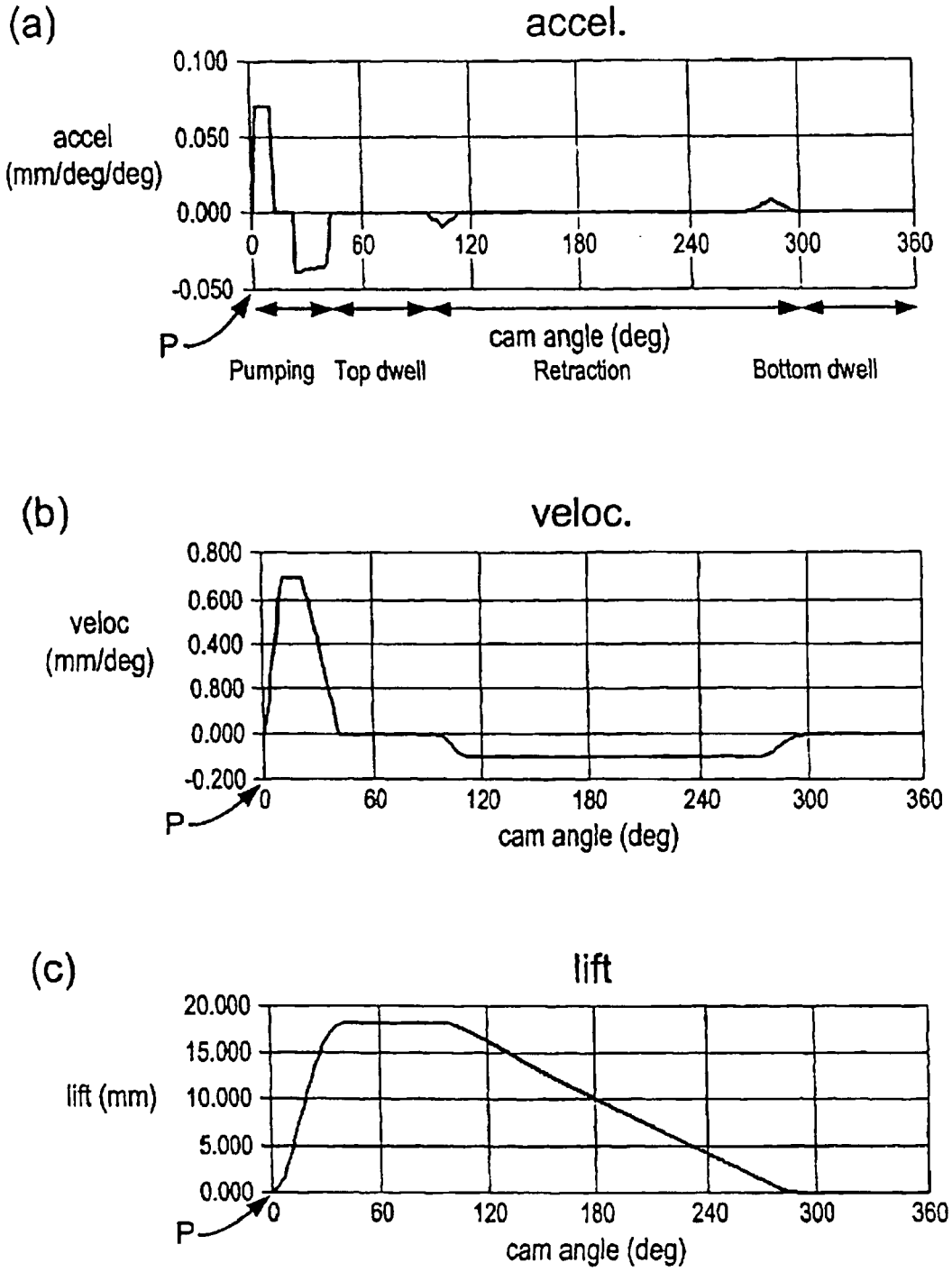
PRIOR ART Fig.2
FIG. 2 shows graphs for (a) acceleration, (b) velocity and (c) plunger lift for the unit injector-cam arrangement of FIG. 1.

FIG. 2 shows various characteristics of plunger behaviour throughout a 360 degree rotation of the cam (i.e. a full pumping cycle). FIG. 2(*a*) shows the acceleration of the pumping plunger as a function of cam (engine) position, and in which the four periods of the cycle are identified: a pumping phase (between about 0 and 45 degrees from a cam reference position, P); top dwell (between about 45 to 100 degrees from the cam reference position, P); a retraction phase (between about 100 and 300 degrees from the cam reference position, P); and bottom dwell (between about 300 and 360 degrees from the cam reference position, P). The velocity of the pumping plunger 16 throughout the pumping cycle is shown in FIG. 2(*b*), and plunger movement or "lift" is represented in FIG. 2(*c*). It is worthy of note that plunger movement during the return stroke between top dwell and bottom dwell, is substantially linear and continuous.

Figure 3:
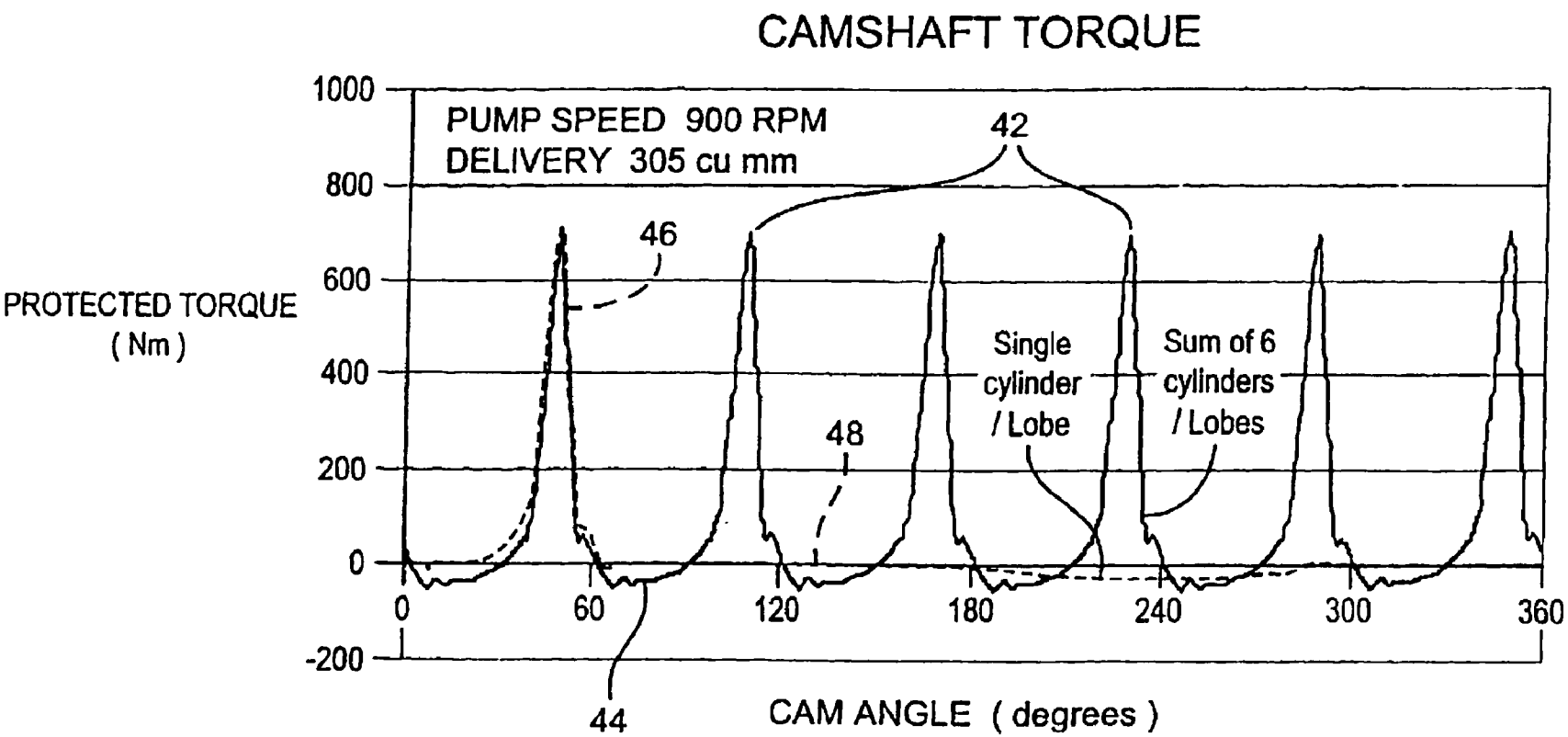
PRIOR ART Fig.3
FIG. 3 is a graph showing the camshaft torque load characteristic for the unit injector-cam arrangement of FIG. 1.

FIG. 3 shows the torque loading (arbitrary units) on the camshaft for a six cylinder fuel pump arrangement. The torque loading characteristic 40 (filled line) shows six torque load peaks 42 (only two of which are identified), one for the pumping stroke for each of the six unit injectors. It can be seen that between the six torque load peaks are regions 44 of negative torque loading (only one indicated). FIG. 3 also shows the torque loading characteristic 46 (dashed line) for a single cylinder engine, having a single unit injector and for which negative torque loading 48 is also apparent.

As described previously, problems arise due to periods of negative torque loading, and in particular torque reversal between periods of positive and negative loading, and this is a common problem in known cam driven unit injector arrangements of the aforementioned type.

Figure 4:
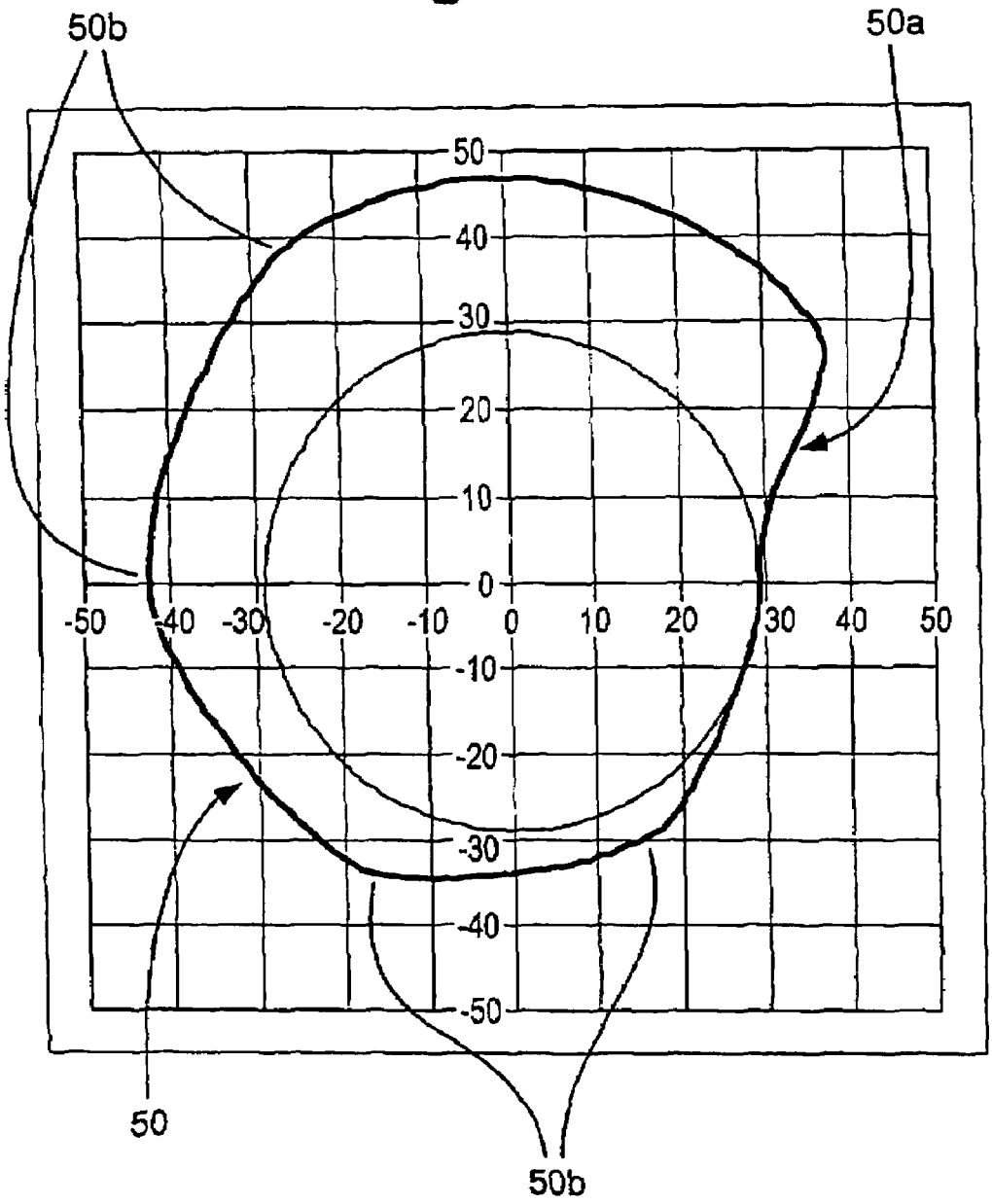
FIG. 4 shows a cam for use in one embodiment of a cam arrangement of the present invention.

FIG. 4 illustrates the profile of the surface of a cam, referred to generally as 50, in accordance with a first embodiment of the present invention, which may be used with a unit injector such as that shown in FIG. 1 to substantially overcome the aforementioned torque loading problems. The surface of the cam 50 differs from that shown in FIG. 1, in that the surface is not regular and "smooth" but instead is somewhat irregular and includes a rising flank 50*a* and several regions of surface irregularity, identified at 50*b*. These regions of surface irregularity 50*b*, alternatively referred to as salient features or portions of the cam surface, are carefully positioned on the surface of the cam 50 to provide a technical benefit when implemented in a six cylinder engine having six unit injectors, one for each cylinder. The six cams for the six unit injectors are mounted upon the camshaft and oriented such that they are angularly offset from one another by substantially 60 degrees. The result of shaping and orientation of the cam surfaces in this way is to substantially eliminate negative torque loading of the camshaft and to reduce the peak torque loading on the shaft due to any one plunger. The reason for this is best described with reference to FIGS. 5 and 6.

Figure 5:
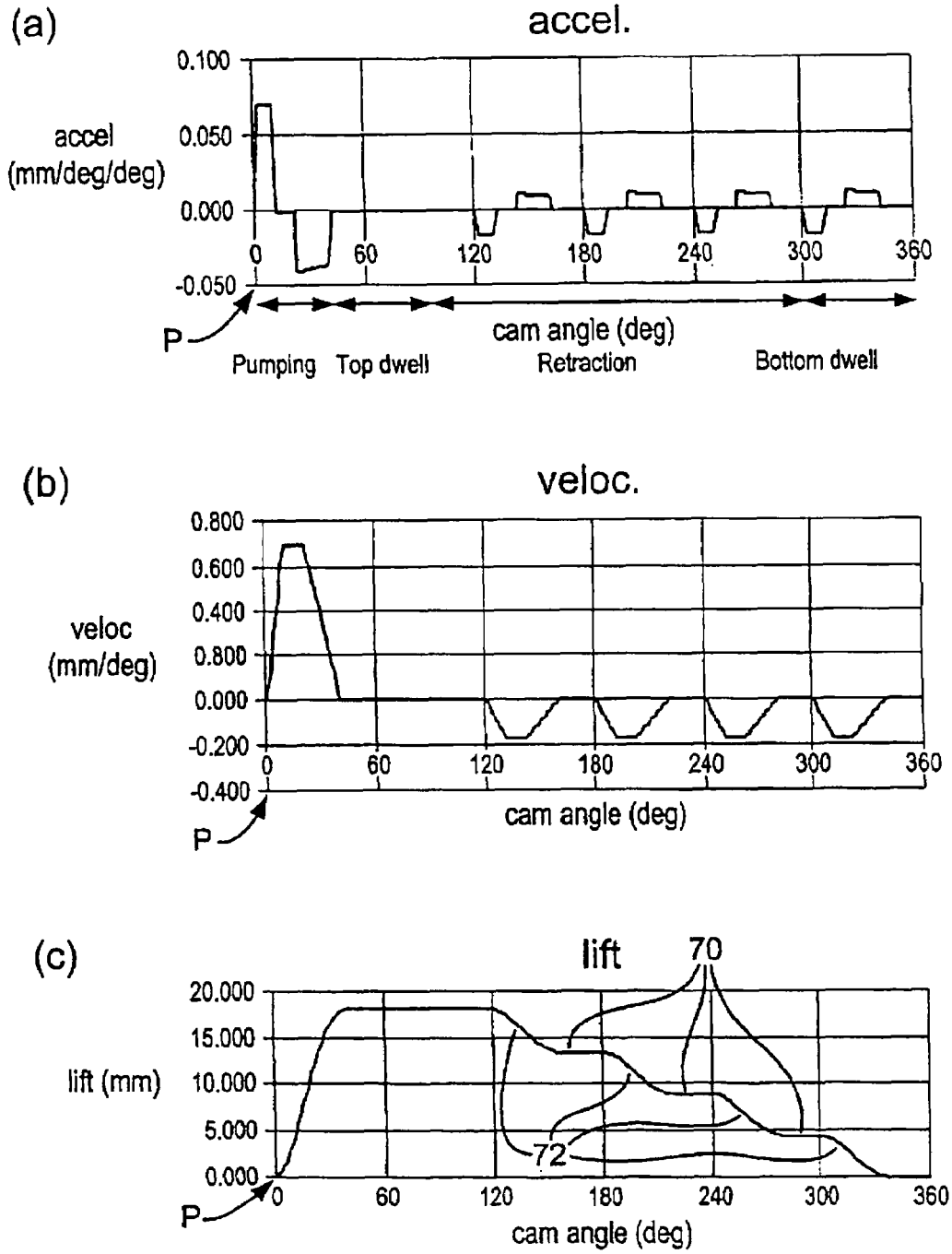
FIG. 5 is a graph showing (a) acceleration, (b) velocity and (c) plunger lift for a unit injector when used with a cam having the form shown in FIG. 4.

FIG. 5 is similar to FIG. 2, and FIGS. 5(*a*), (*b*) and (*c*) illustrate the acceleration, velocity and plunger movement characteristics respectively of one of the pumping plungers of a six-plunger pump arrangement with which the cam surface profile shown in FIG. 4 is used. The pumping phase (between about 0 and 40 degrees from the cam reference position, P) is followed by a period of top dwell (between about 40 and 120 degrees from the cam reference position, P), where the plunger 16 dwells at the top of the rising flank 50*a* before following the falling flank under the influence of the return spring force. The return stroke of the plunger follows the period of top dwell, and the characteristics of plunger movement during the return stroke differ significantly from those shown in FIG. 2 for the conventional cam design.

As can be seen in FIG. 5(*c*), plunger movement during the return stroke is discontinuous, or interrupted, and the return stroke for this particular plunger thus comprises a number of separate and discrete steps of movement 72, rather than exhibiting continuous movement (as illustrated in FIG. 2(*c*)). The steps of movement 72 are separated by intervals of interruption 70 in the return stroke, during which the plunger is substantially stationary or "dwells". The angular cam positions at which the steps of movement 72 occur, and the orientations of the cams relative to one another, are selected carefully by design such that the steps of movement 72 through the return stroke substantially coincide with the pumping stroke of one of the other plungers 16. This is best illustrated by comparing FIGS. 2(*c*) and 5(*c*), from which comparison it can be seen that the periods of interruption 70 in FIG. 5(*c*) where the plunger is stationary are periods during which the plunger would be moving if a conventional cam form were used.

In the example of a six-cylinder engine having six unit injectors (as shown in FIG. 1), the interruptions in retracting movement of the plunger are arranged to occur at around 120, 180, 240 and 300 degrees (i.e. four times) from the cam reference position, P. As six cams are angularly offset from one another by substantially 60 degrees, each one of the steps of return stroke movement 72 substantially coincides with the pumping stroke of one of the other plungers.

The cam surfaces are shaped such that for any one plunger there are only four occurrences of a step of movement 72 through the return stroke, separating three intervals 70 during which movement is interrupted. The pumping stroke for each plunger will therefore only coincide with a step of movement 72 through the return stroke of four of the other plungers (i.e. all but one of the other plungers). In this example, this is because the cam is designed to provide a pumping cycle having a relatively long top dwell period (between 60 and 120 degrees relative to the cam reference position, P).

Figure 6:
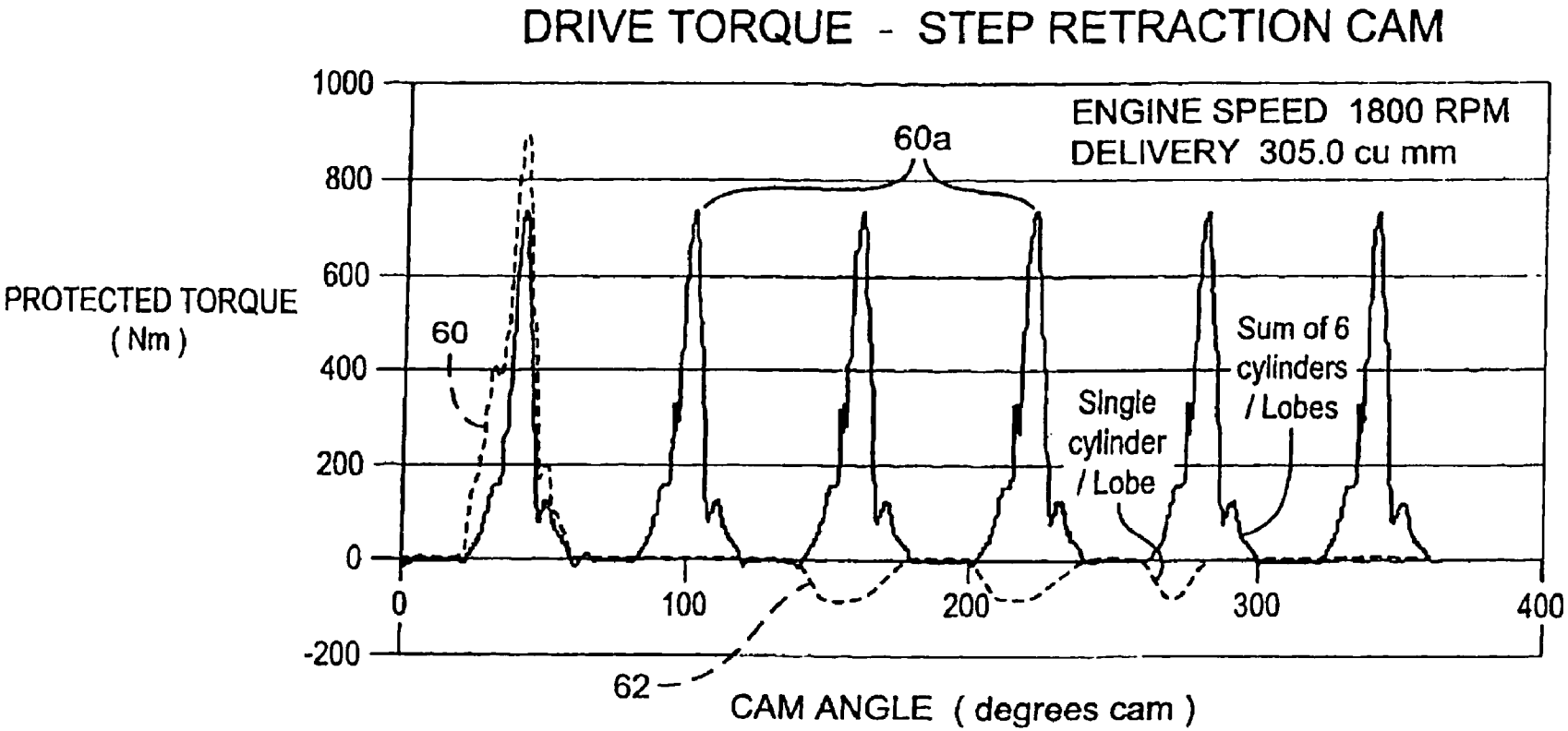
FIG. 6 is a graph showing the camshaft torque load characteristic for a unit injector when used with a cam having the form shown in FIG. 4.

By way of comparison with FIG. 3, FIG. 6 shows the torque loading characteristic 60 of the cam in FIG. 4 (the units of torque loading on the y-axis are arbitrary). As in FIG. 3, six torque load peaks are apparent (e.g. 60*a*), corresponding to the pumping phases of the six plungers, but now the periods of negative torque loading between the torque peaks have been substantially eliminated. This benefit is achieved by shaping the cam to provide interrupted movement through the return stroke, with the steps of movement 72 being substantially synchronous with the pumping stroke for at least one of the other plungers. It is a further benefit of the cam arrangement of this embodiment of the invention that the peak torque loading on the camshaft due to any one plunger is reduced, as can be seen by comparing the solid and dashed lines of FIG. 6.

In order to determine the desired cam shaping to achieve the aforementioned technical advantage, it is most convenient to first select an appropriate rising flank profile to provide the required pumping phase characteristics. Having established this, it is then necessary to "invert" the pumping phase movement and to divide this by the number of pumping strokes of a plunger that are to be synchronised with the steps of movement 72 through the return stroke, taking into consideration, for example, any requirement for top and bottom dwell periods. This determines the plunger movement required for each step 72. The angular cam positions at which the steps of movement 72 through the return stroke occur are determined by the positions of the pumping flanks of the other cams.

In the example illustrated in FIGS. 4 and 5, the "inverted" pumping stroke is divided by four to implement retraction of the plunger in four steps, with the location of the retraction steps being selected for synchronisation with four of the other plunger pumping strokes. In an alternative example, three steps of movement 72 through the return stroke may be preferred to four, for example if it is desirable for there to be a longer bottom dwell period. As a general rule, however, it may be desirable for there to be a number of steps of movement 72, separated by intervals of interruption 70, that is one less than the total number of plungers in the pump.

In a further alternative embodiment (not shown) of the cam arrangement to that shown in FIG. 4, the surface of the cam 50 may be shaped such that interrupted movement throughout the return stroke gives rise to there being a number of steps of movement 72 that is equal to the number of other plungers in the pump.

The cam arrangement may be configured such that there is only one step in the return stroke of each plunger, but in practice it may be preferable for each plunger return stroke to have a multiple number of steps as this permits filling of the pump chambers at a slower rate, and may alleviate problems associated with cavitation erosion.

As an alternative to the unit injector design of FIG. 1, the embodiment of the cam arrangement shown in FIG. 4 is also suitable for use with more sophisticated unit injectors within which an additional injection control valve means is provided to control the timing of fuel delivery to the engine. Such injectors include an injection control valve means in the form of an injection control valve, which is arranged to control fuel pressure within a control chamber at the back of the valve needle. In addition to the valve needle spring 15, fuel pressure within the pressure control chamber serves to urge the valve needle to close, so that by reducing this pressure the valve needle is caused to lift to commence injection. Such injectors permit a pilot injection of fuel before a main injection of the same pumping cycle, or a post injection of fuel to follow a main injection of fuel, and these may have benefits in terms of emissions (reference earlier patent application). The particular cam surface shaping described with reference to FIGS. 4 and 5 is therefore particularly suitable for this type of injector arrangement, as it provides a relatively long top dwell period during which a post injection of fuel can be delivered.

The cam arrangement of the present invention may also be implemented with particular advantage in more recently developed hybrid injector-common rail fuel injection systems (not shown), where problems associated with reversal of the camshaft torque loading are exaggerated due to the significant pressures that may be present in the pump chambers throughout full cam rotation. A hybrid fuel injection system of this type may include two (or more) plungers, each of which is driven by a respective cam to cause pressurisation of fuel within an associated pump chamber, as described previously for the unit injector. The pump chambers communicate with a common rail under the control of a control valve having open and closed positions. With the control valve in its open position, fuel within the common rail, which is already at a relatively high level, is supplied to the pump chamber and can be pressurised to higher levels for injection if the control valve is closed as the plunger performs its pumping stroke. Such hybrid injector-common rail schemes are particularly convenient for achieving a so-called "boot shaped" injection characteristic, which benefits emission levels and permits pilot or post injections of fuel in addition to the main injection of fuel.

If the hybrid system has just two plungers, two cams are provided. In a preferred embodiment, the return stroke for each plunger is not interrupted at all, but the cams are shaped and oriented such that the return stroke of each coincides with the pumping stroke of the other. This aspect of the invention can be extended for use with pump arrangements having a greater number of plungers (e.g. 3 or 4), with the return stroke of each plunger being synchronised with the pumping stroke of one of the other plungers.

Alternatively, the return stroke for each of the plungers may be interrupted just once (i.e. it has just a single interval), with one of the steps of movement either side of the interruption being substantially synchronous or coincident with the pumping stroke of the other plunger.

It will be appreciated from the description of the embodiments described that the shape of the cam of the present invention may be adapted for two or four cylinder engines, or for an engine having any other practicable number of cylinders, without deviating from the scope of the invention as set out in the claims.

The invention claimed is:

1. A fuel pump arrangement for delivering high pressure fuel to an associated engine, the fuel pump arrangement including three or more pumping plungers;

each pumping plunger having:

an associated pump chamber;

return biasing means for effecting a return stroke of the plunger; and an associated cam for driving the plunger to perform a pumping stroke against the return biasing means, during which pumping stroke fuel within the pump chamber is pressurised;

wherein each cam is oriented relative to each other cam;

wherein each cam has a surface shaped such that the return stroke of its associated plunger is intermittently interrupted to define a plurality of steps that are each characterized by an interval of discontinued plunger movement, during which interval the pumping plunger is substantially stationary; and wherein each such step of discontinued plunger movement is substantially coincident with a pumping a stroke of at least one of the other plungers, thereby to reduce negative torque loading of the camshaft.

2. The fuel pump arrangement as claimed in claim 1, wherein each cam surface is shaped to include a rising flank and a falling flank, the falling flank having a plurality of irregularities defining the steps of plunger movement, and wherein the cams are mounted upon the engine camshaft, in use, at angularly offset locations to ensure the or each step of movement through a plunger return stroke substantially coincides with the pumping stroke of one of the other plungers.

3. The fuel pump arrangement as claimed in claim 1, wherein each cam surface is shaped to define a number of steps of movement through the plunger return stroke that is equal to the number of other plungers in the pump arrangement.

4. The fuel pump arrangement as claimed in claim 1, wherein each cam surface is shaped to define a number of steps of movement through the plunger return stroke that is less than the number of other plungers in the pump arrangement.

5. The fuel pump arrangement as claimed in claim 1, wherein each cam surface is shaped such that there is a relatively long period of top dwell prior to commencement of the return stroke.

6. The fuel pump arrangement as claimed in claim 5, wherein top dwell is arranged to continue until about 90 degrees of cam rotation relative to a cam reference position at or close to commencement of the pumping stroke for said plunger.

7. The fuel pump arrangement as claimed in claim 1, wherein each cam surface is shaped such that there is a relatively long period of bottom dwell prior to commencement of the pumping stroke.

8. The fuel pump arrangement as claimed in claim 7, wherein bottom dwell is arranged to occur between about 300 and 360 degrees of cam rotation relative to a cam reference position at or close to commencement of the pumping stroke for said plunger.

9. The fuel pump arrangement as claimed in claim 1, wherein the return biasing means includes a return spring.

10. The fuel pump arrangement as claimed in claim 1, wherein each of the plungers forms part of a unit injector, including a unit housing for the plunger and an associated injector, and whereby the pump chamber associated with each unit injector is arranged to deliver fuel to the associated injector, and to no other injector.

11. The fuel pump arrangement as claimed in claim 1, for use in a hybrid unit/pump injector-common rail fuel injection system, including a common rail from which fuel is delivered to the pump chambers of the unit injectors under the control of a control valve.

12. A cam arrangement for use with a high pressure fuel pump arrangement including three or more pumping plungers, each pumping plunger having an associated pump chamber and return biasing means for effecting a return stroke of the plunger, the cam arrangement comprising a plurality of individual cams rotationally oriented relative to one another, each cam being positioned for driving the plunger to perform a pumping stroke against the return biasing means, during which pumping stroke fuel within the pump chamber is pressurized;

wherein each individual cam has a surface shaped such that the return stroke of its associated plunger is intermittently interrupted to define a plurality of steps that are each characterized by an interval of discontinued plunger movement, during which interval the pumping plunger is substantially stationary; and wherein each such step of discontinued plunger movement is substantially coincident with a pumping stroke of at least one of the other plungers.

13. A single cam for use in a cam arrangement that includes a plurality of individual cams rotationally oriented relative to one another, the cam arrangement adapted for use with a high pressure fuel pump arrangement including three or more pumping plungers, each pumping plunger having an associated pump chamber and return biasing means for effecting a return stroke of the plunger;

wherein the cam is positioned for driving the plunger to perform a pumping stroke against the return biasing means, during which pumping stroke fuel within the pump chamber is pressurized;

wherein the cam has a surface shaped such that the return stroke of its associated plunger is intermittently interrupted to define a plurality of steps that are each characterized by an interval of discontinued plunger movement, during which interval the pumping plunger is substantially stationary; and wherein each such step of discontinued plunger movement is substantially coincident with a pumping stroke of at least one of the other plungers.

* * * * *